US008206835B2

(12) United States Patent
Chen

(10) Patent No.: US 8,206,835 B2
(45) Date of Patent: Jun. 26, 2012

(54) HANGING ORNAMENT FOR COLOR PAINTING

(76) Inventor: Teng-Kuei Chen, Taipei (TW)

( * ) Notice: Subject to any disclaimer, the term of this patent is extended or adjusted under 35 U.S.C. 154(b) by 273 days.

(21) Appl. No.: 12/770,860

(22) Filed: Apr. 30, 2010

(65) Prior Publication Data

US 2011/0268981 A1 Nov. 3, 2011

(51) Int. Cl.
*B44D 2/00* (2006.01)

(52) U.S. Cl. ..... 428/542.2; 428/38; 428/156; 434/84

(58) Field of Classification Search ..... 428/542.2, 428/38, 138; 156/62, 63
See application file for complete search history.

(56) References Cited

U.S. PATENT DOCUMENTS 2,811,800 A * 11/1957 Gesek ..... 156/62
3,382,134 A * 5/1968 Powell ..... 428/38
3,533,889 A * 10/1970 Powell ..... 428/155
3,546,051 A * 12/1970 Utz ..... 428/38
3,619,456 A * 11/1971 Taylor, Jr. ..... 264/245
3,833,450 A * 9/1974 Powell ..... 428/15
4,139,667 A * 2/1979 Blue ..... 428/38
4,312,688 A * 1/1982 Brodis et al. ..... 156/63
4,411,855 A * 10/1983 Fiebig et al. ..... 264/219
4,476,171 A * 10/1984 Takeuchi ..... 428/38
5,039,468 A * 8/1991 Sellers ..... 264/225
5,492,739 A * 2/1996 Thorne et al. ..... 428/38
6,221,302 B1 * 4/2001 Arai ..... 264/496
2011/0268981 A1 * 11/2011 Chen ..... 428/542.2

FOREIGN PATENT DOCUMENTS

JP 3157930 U * 3/2010

* cited by examiner

*Primary Examiner* — Aaron Austin
(74) *Attorney, Agent, or Firm* — Alan Kamrath; Kamrath IP Lawfirm, PA

(57) ABSTRACT

A hanging ornament for color painting has a substrate, a first ridge area and a second ridge area. The substrate has a first surface, a second surface and a protrudent surface. The first and second surfaces are both sides of the substrate. The protrudent surface protrudes from a partial area of the first surface to the second surface and is formed on the second surface. The first ridge area and the second ridge area are integrally formed on the second surface and the protrudent surface and have different heights and the recesses delineated by the first and second ridge areas are available for users to paint. The present invention addresses a means being more convenient to paint and visually appealing to users, and a solution to manufacturers saving more material, simplifying the production procedures and requiring minimum mold.

16 Claims, 7 Drawing Sheets

B-B

B-B

HANGING ORNAMENT FOR COLOR PAINTING

BACKGROUND OF THE INVENTION

1. Field of the Invention

The present invention is related to a hanging ornament, and more particularly to a hanging ornament for color painting having two-sided painted ridges integrally formed on two opposite surfaces of a substrate and protruding with different heights.

2. Description of the Related Art

Stained glass is an attractive decoration. However, traditional techniques for making stained glass are complex and require use of hazardous materials so is not suitable for home crafts. Further, traditional stained glass crafts are substantially two-dimensional.

With reference to FIG. 4, a conventional hanging ornament for color painting has a substrate (7), multiple base ridges (81), multiple base recesses (82), and a hanging hole (9). The base ridges (81) are formed on the substrate (7). As the substrate (7) is pellucid, the base recesses (82) are delineated by the base ridges (81) to facilitate users painting therein and the base ridges (81) may be stained black or other color. The hanging hole (9) is formed through a top position of the substrate (7). After users paint in the base recesses (82) and the paints in the base recesses (82) are dry, a hanging ornament for color painting is completed.

With reference to FIG. 5, to make a portion of the base ridges (81) stand out from the rest of the base ridges (81), manufacturers additionally provide a decorative element (83) to correspond to a highlighted base ridge portion (84) of the hanging ornament for color painting. For example, the base ridges (8) outline flowers and birds, and the highlighted base ridge portion (84) outlines a bird over a lower end. The decorative element (83) can be mounted on the highlighted base ridge portion (84) by a mounting means. With reference to FIG. 6, the mounting means has pins formed on an inner surface of the decorative element (83) and pinholes respectively formed in the recessed surface (85) within the highlighted base ridge portion (84). With reference to FIG. 7, the mounting means may apply adhesive to adhere the inner surface of the decorative element (83) to the outer surface of the highlighted base ridge portion (84). Similarly, to facilitate uses to paint the decorative element (83), the decorative element (83) has multiple decorative ridges (84') and multiple decorative recesses (85). The decorative ridges (84') correspond to the highlighted base ridge portion (84) on the substrate (7) so that users can paint in the decorative recesses (85) delineated by the decorative ridges (84').

However, it takes an additional mold for such conventional hanging ornament for color painting to produce the decorative element (83). The decorative ridges (84') of the decorative element (83) also needs to be printed to highlight the decorative recesses (85) to be painted. As far as the overall production procedures are concerned, the hanging ornament for color painting and the decorative element (83) require different molds for production and more than one printing steps to print the base ridges (81) of the hanging ornament for color painting and the decorative ridges (84') of the decorative element (83) in addition to more material used for the highlighted base ridge portion (84). Besides, the assembly of the hanging ornament for color painting and the decorative element (83) are loose, easy to fall off, and visually poor due to uneven and discontinuous connection thereof, and the base ridges and the decorative ridges of the hanging ornament for color painting are on only one side. Hence, complexity of production procedures, reduction of material, appealing look and user's convenience of the conventional hanging ornament for color painting can be further refined.

SUMMARY OF THE INVENTION

An objective of the present invention is to provide a three-dimensional color-painted hanging ornament for color painting integrally formed on two opposite surfaces of a plate and protruding with different heights.

To achieve the foregoing objective, the three-dimensional color-painted hanging ornament for color painting has a substrate, a first ridge area and a second ridge area.

The substrate has a first surface, a second surface and a protrudent surface. The second surface is opposite to the first surface. The protrudent surface protrudes from a partial area of the first surface to the second surface and is formed on the second surface.

The first ridge area is integrally formed on a remaining area of the first surface and has multiple first ridges and multiple first recesses delineated by the first ridges.

The second ridge area is integrally formed on the protrudent surface and has multiple second ridges and multiple second recess portions delineated by the second ridges.

A height of the protrudent surface relative to the second surface is more than a height of the first ridge area relative to the first surface.

The hanging ornament for color painting requires one mold to integrally form the first ridge area and the second ridge area having different altitudes, thereby achieving two-sided colorful look of painting areas differing in altitude and addressing a means being more convenient to paint and visually appealing to users and a solution saving more material, simplifying the production procedures and requiring minimum mold for manufacturers.

DETAILED DESCRIPTION OF THE INVENTION

Figure 1:
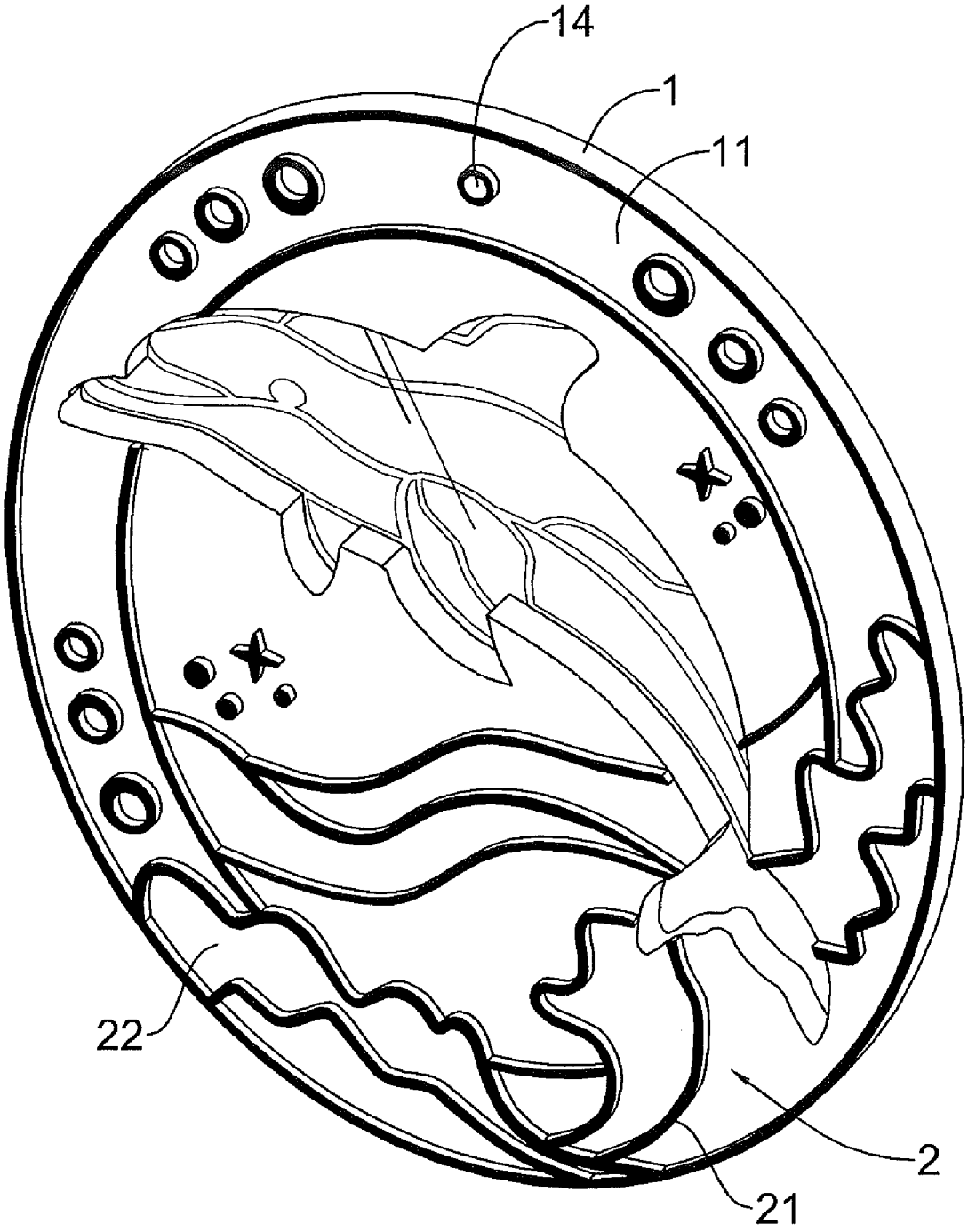
FIG. 1 is a rear perspective view of a first embodiment of a hanging ornament for color painting in accordance with the present invention.
Figure 2:
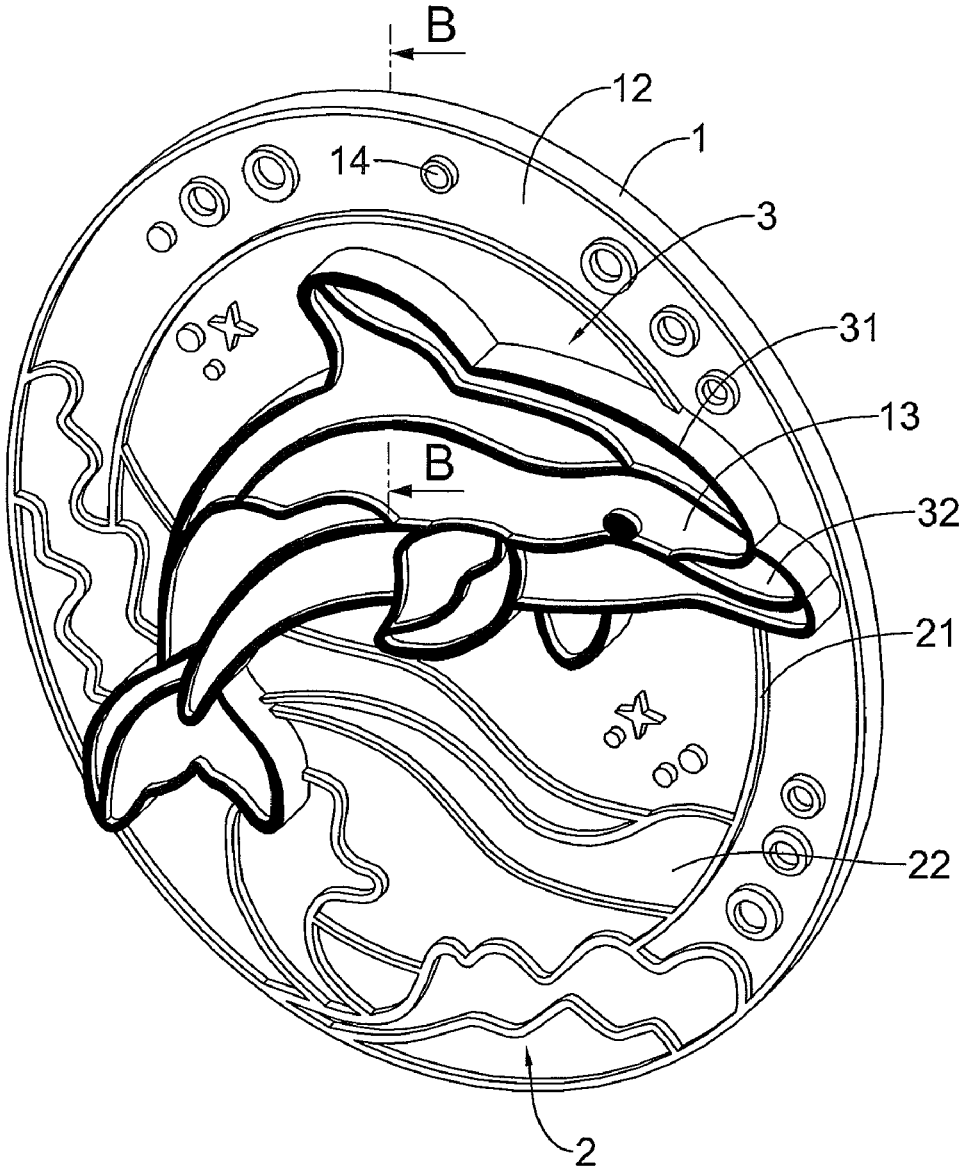
FIG. 2 is a front perspective view of the hanging ornament for color painting in FIG. 1.
Figure 3:
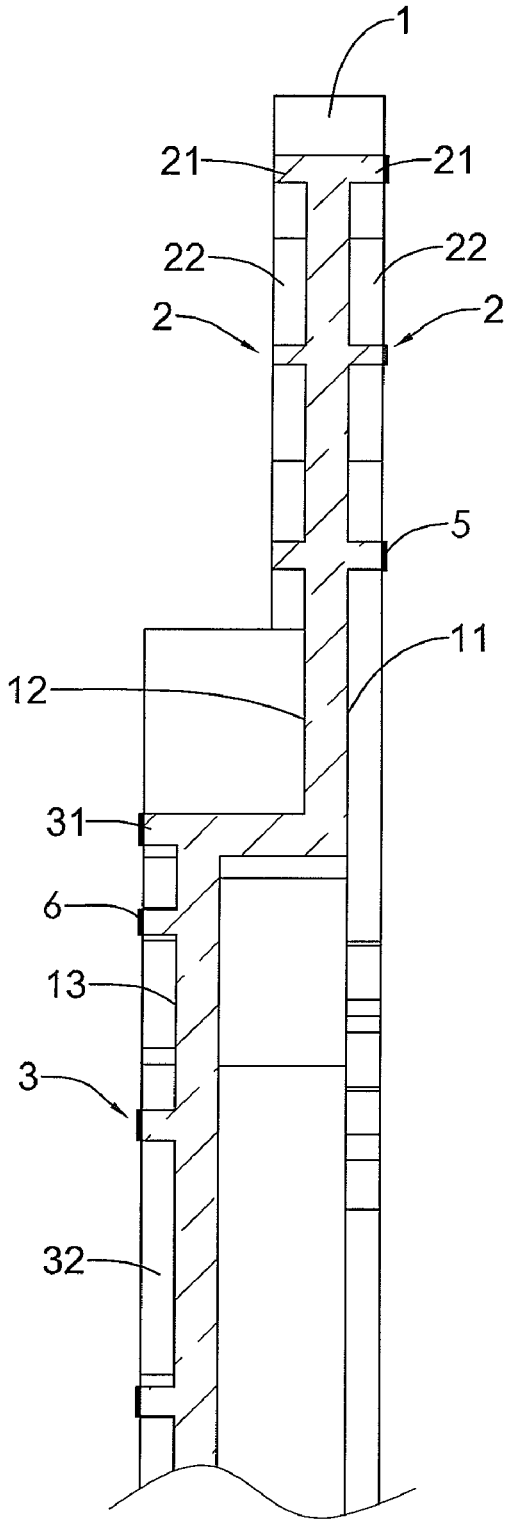
FIG. 3 is a cross-sectional view of the hanging ornament for color painting taken along line B-B of FIG. 2.
Figure 4:
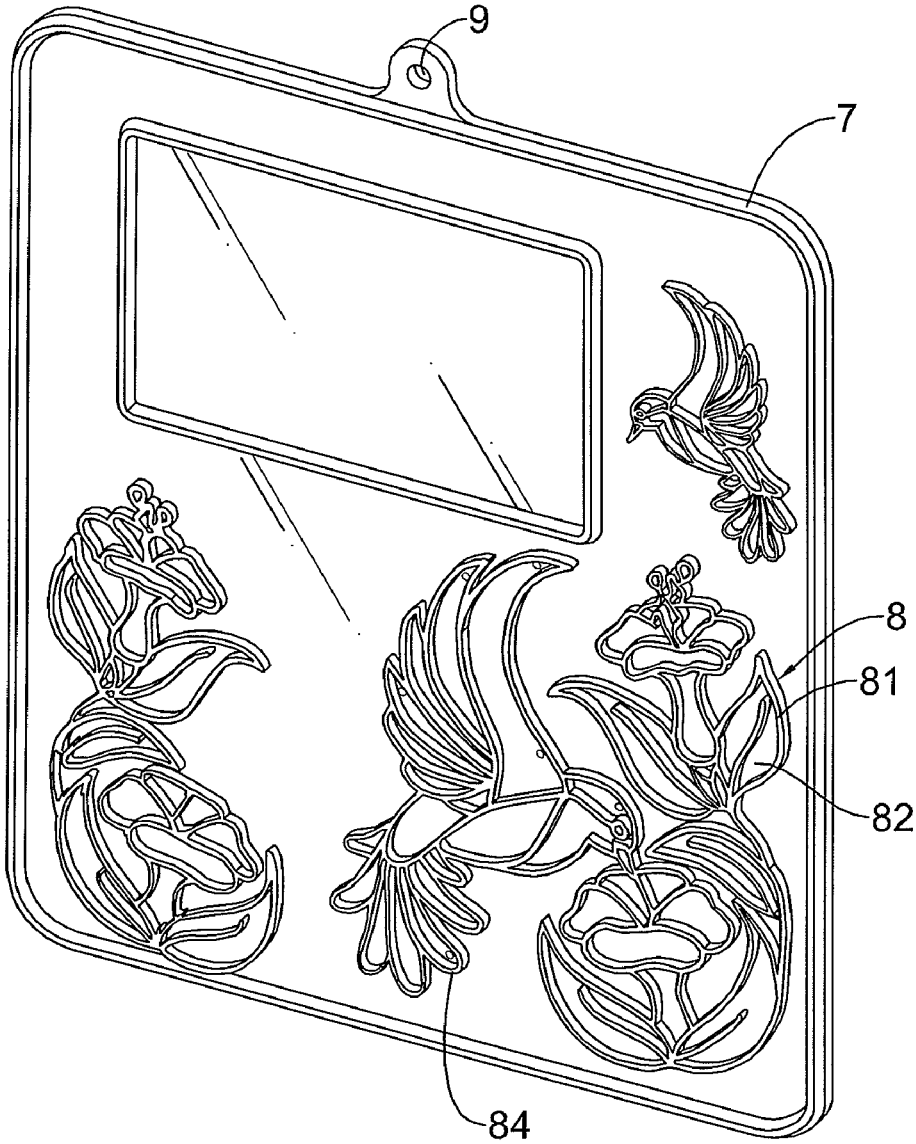
FIG. 4 is a perspective view of a conventional hanging ornament for color painting.
Figure 5:
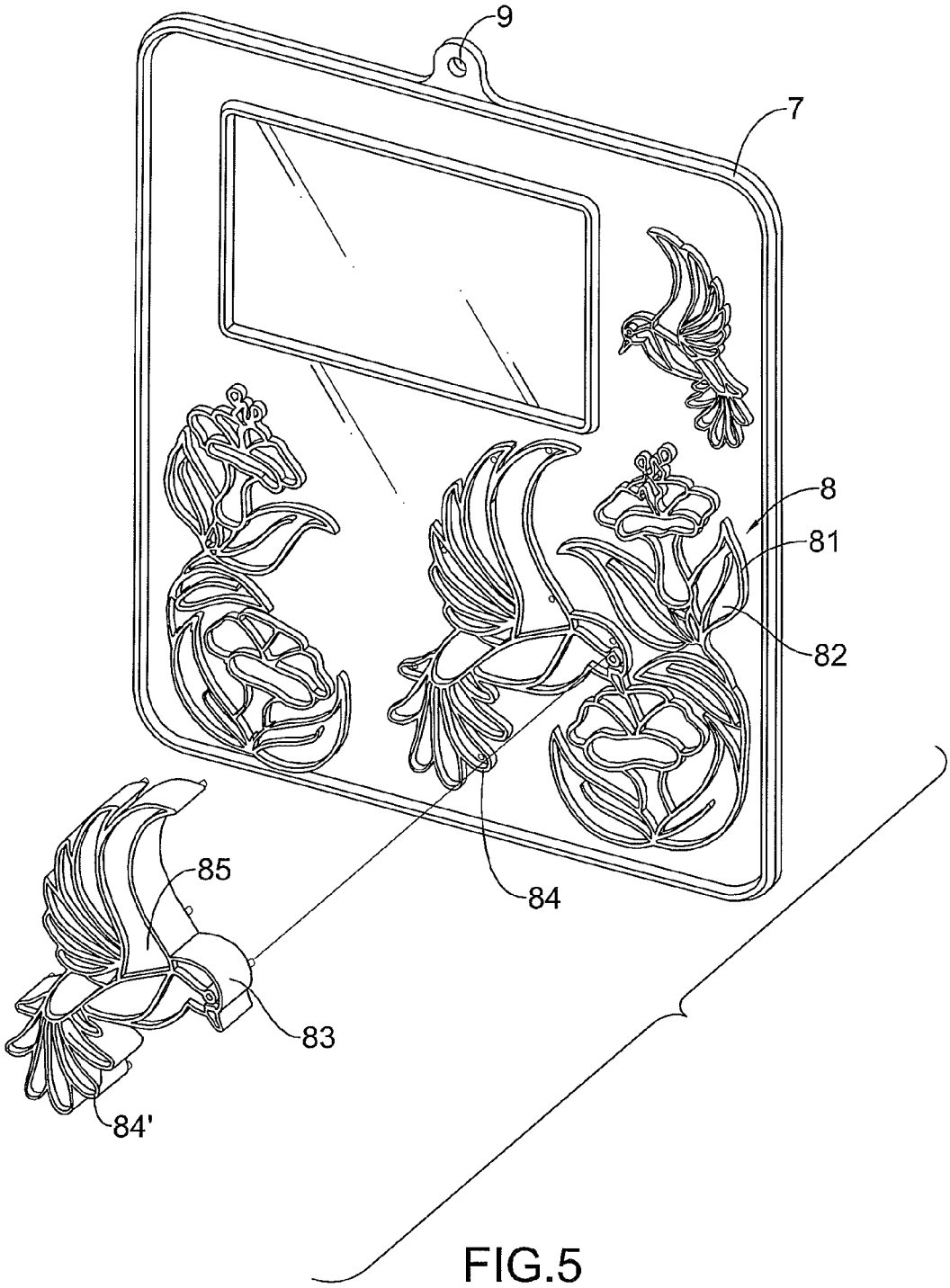
FIG. 5 is an exploded perspective view of a conventional hanging ornament for color painting.
Figure 6:
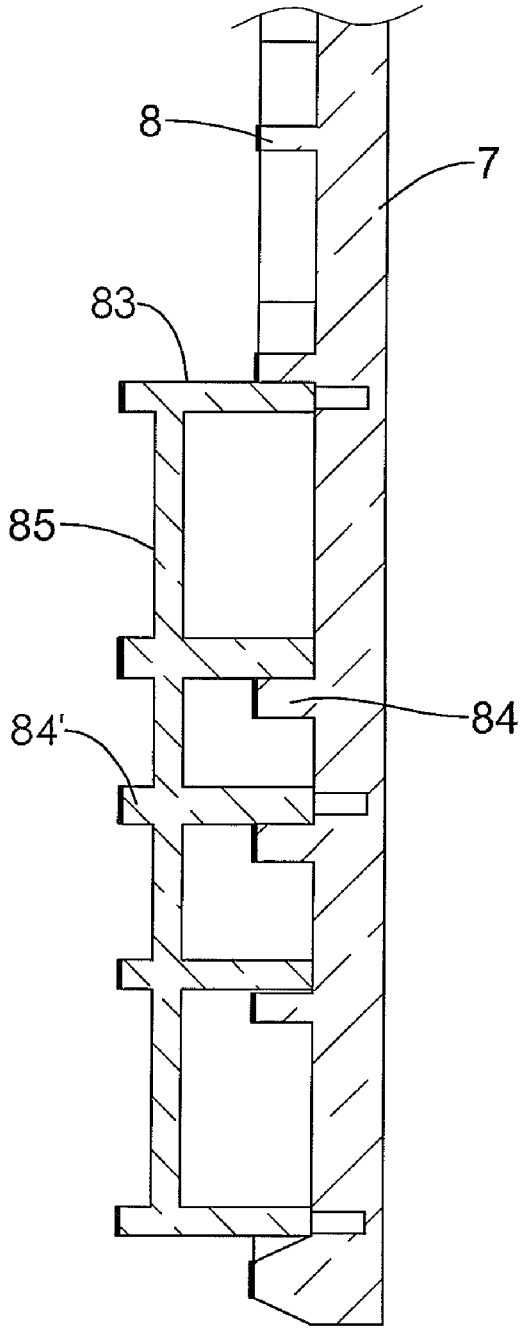
FIG.6 PRIOR ART
FIG. 6 is an enlarged cross-sectional view of the conventional hanging ornament for color painting in FIG. 5; a decorative element connected using pins and pinholes.
Figure 7:
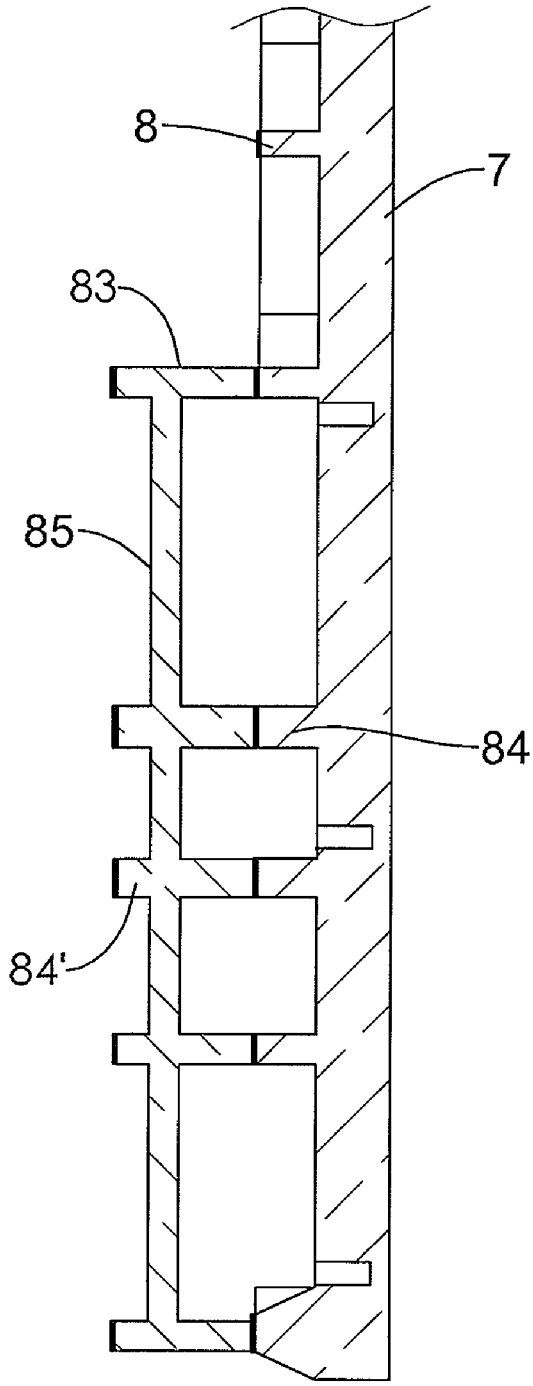
FIG.7 PRIOR ART
FIG. 7 is an enlarged cross-sectional view of the conventional hanging ornament for color painting in FIG. 5, connected using adhesive.

With reference to FIGS. 1 to 3, a hanging ornament for color painting (1) has a substrate (1), a first ridge area (2) and a second ridge area (3).

The substrate (1) is pellucid, may be made from AS (acrylonitrile styrene) plastic material, PS (polystyrene) plastic material and acrylic with good light transmittance, and has a first surface (11), a second surface (12), a protrudent surface (13) and a hanging hole (14). The first surface (11) and the second surface (12) are both sides of the substrate (1). The protrudent surface (13) protrudes from a partial area of the first surface (11) toward the second surface (12) and is formed on the second surface (12). The hanging hole (14) is formed through an edge of the substrate (1) for hanging the hanging ornament for color painting on a wall, a door and the like for decoration.

The first ridge area (2) is integrally formed on the remaining area of the first surface (11) and has multiple first ridges (21) printed with a first color. The second ridge area (3) is integrally formed on the protrudent surface (13) and has multiple second ridges (31) printed with a second color. The second color may be the same as or different from the first color. The first color (5) and the second color (6) may be paint, resin or ink printed, gilt or transfer-printed onto the corresponding ridges (21, 31).

As a height of the protrudent surface (13) relative to the second surface (12) is more than that of the first ridge area (2) relative to the first surface (11), the second ridge area (3) relatively stands out more when compared with the first ridge area (2). In the present embodiment, the second ridge area (3) on the protrudent surface (13) may take a form of a dolphin. The second ridges (31) of the second ridge area (3) delineate lines of the dolphin and multiple second recesses (32) for users to paint.

The first ridge area (2) can be symmetrically formed on the second surface (11). As the first ridges (21) and the second ridges (31) are both located on the second surface and the second ridges (31) are higher than the first ridges (21), it is the second ridges (31) of the second ridge area (3) is printed with the second color (6) only. However, since the substrate (1) is pellucid, the first color (5) printed on the first ridges (21) of the first ridge area (2) on the first surface (11) is still visible to users. Therefore, users can paint multiple first recesses (22) delineated by the first ridges (21) and the second recesses (32) delineated by the second ridges (31) on the second surface (12) to create layered color painting effect.

In sum, the hanging ornament for color painting has the first ridge area (2) integrally formed on the first surface (11) and the second surface (12) with a single mold. The second ridge area (3) further protrudes upwardly from the protrudent surface (13) of the second surface (12) to be highlighted and is integrally formed on the substrate (1) without requiring to mount additional decorative element on a highlighted ridge portion. Furthermore, the first and second ridges (21, 31) respectively formed on the first ridge area (2) of the first surface (11) and second ridge area (3) of the second surface (12) can be printed in one printing step to generate two-sided printed patterns. As a result, the present invention is more convenient to paint and visually appealing to users, and addresses a solution to manufacturers to save more material, simplify the production procedures and require minimum mold.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A hanging ornament for color painting comprising:

a substrate having a first surface;

a second surface being opposite to the first surface; and a protrudent surface protruding from a partial area of the first surface to the second surface and formed on the second surface;

a first ridge area integrally formed on a remaining area of the first surface, and having multiple first ridges and multiple first recesses delineated by the first ridges; and a second ridge area integrally formed on the protrudent surface, and having multiple second ridges and multiple second recesses delineated by the second ridges;

wherein a height of the protrudent surface relative to the second surface is more than a height of the first ridge area relative to the first surface.

2. The hanging ornament for color painting as claimed in claim 1, wherein the substrate further has a hanging hole.

3. The hanging ornament for color painting as claimed in claim 1, wherein the first ridges of the first ridge area and the second ridges of the second ridge area are printed with different colors.

4. The hanging ornament for color painting as claimed in claim 1, wherein the first ridges of the first ridge area and the second ridges of the second ridge area are printed with a same color.

5. The hanging ornament for color painting as claimed in claim 1, wherein the substrate is made from an AS (acrylonitrile styrene) plastic material.

6. The hanging ornament for color painting as claimed in claim 2, wherein the substrate is made from an AS plastic material.

7. The hanging ornament for color painting as claimed in claim 3, wherein the substrate is made from an AS plastic material.

8. The hanging ornament for color painting as claimed in claim 4, wherein the substrate is made from an AS plastic material.

9. The hanging ornament for color painting as claimed in claim 1, wherein the substrate is made from a PS (polystyrene) plastic material.

10. The hanging ornament for color painting as claimed in claim 2, wherein the substrate is made from a PS plastic material.

11. The hanging ornament for color painting as claimed in claim 3, wherein the substrate is made from a PS plastic material.

12. The hanging ornament for color painting as claimed in claim 4, wherein the substrate is made from a PS plastic material.

13. The hanging ornament for color painting as claimed in claim 1, wherein the substrate is made from an acrylic material.

14. The hanging ornament for color painting as claimed in claim 2, wherein the substrate is made from an acrylic material.

15. The hanging ornament for color painting as claimed in claim 3, wherein the substrate is made from an acrylic material.

16. The hanging ornament for color painting as claimed in claim 4, wherein the substrate is made from an acrylic material.

* * * * *